US005881402A

United States Patent [19]

Devino et al.

[11] Patent Number: 5,881,402

[45] Date of Patent: Mar. 16, 1999

[54] PORTABLE IN-GROUND POOL

[76] Inventors: Dennis Michael Devino; Lynn Estelle Devino, both of 40 North Cir., Aberdeen, N.J. 07747

[21] Appl. No.: 843,729

[22] Filed: Apr. 21, 1997

Related U.S. Application Data

[63] Continuation-in-part of Ser. No. 622,437, Mar. 25, 1996, abandoned.

[51] Int. Cl.[6] ..... E04H 4/00

[52] U.S. Cl. ..... 4/494; 4/506; 4/513; 52/2.11; 463/49; 273/317; 273/351

[58] Field of Search ..... 4/488, 496, 506, 4/513, 584, 585, 586, 588, 499, 503; 472/126, 116, 117; 52/2.11; 463/49; 273/317, 351, 415

[56] References Cited

U.S. PATENT DOCUMENTS

| | | | |
|---|---|---|---|
| 2,505,845 | 5/1950 | Alvarez . | |
| 2,529,872 | 11/1950 | Hasselquist . | |
| 2,616,096 | 11/1952 | Hasselquist . | |
| 2,689,812 | 9/1954 | Mollica et al. . | |
| 2,718,014 | 9/1955 | Mizrach et al. . | |
| 2,838,768 | 6/1958 | Fischette . | |
| 2,883,676 | 4/1959 | Kwake | 4/503 |
| 2,990,837 | 7/1961 | Cushman . | |
| 3,001,207 | 9/1961 | Nail . | |
| 3,633,221 | 1/1972 | Addison et al. | 4/513 |
| 3,667,070 | 6/1972 | Pitti et al. | 4/503 |
| 3,693,194 | 9/1972 | Schindler et al. | 4/488 |
| 3,710,401 | 1/1973 | Goettl . | |
| 3,740,036 | 6/1973 | Ames | 273/317 |
| 3,823,426 | 7/1974 | Mitchko . | |
| 4,335,473 | 6/1982 | de Pous . | |
| 4,547,919 | 10/1985 | Wang . | |
| 4,597,113 | 7/1986 | Eymard . | |
| 4,599,753 | 7/1986 | Goodman | 4/488 |
| 4,651,360 | 3/1987 | Wang . | |
| 4,935,970 | 6/1990 | Aristone . | |
| 4,986,549 | 1/1991 | Kuhtic et al. | 273/415 |
| 5,134,857 | 8/1992 | Burley | 4/506 |
| 5,205,791 | 4/1993 | Pledger . | |
| 5,311,620 | 5/1994 | Ratje | 4/599 |

FOREIGN PATENT DOCUMENTS

| | | | |
|---|---|---|---|
| 1221425 | 7/1966 | Germany . | |
| 1429766 | 2/1969 | Germany . | |
| 289540 | 3/1965 | Netherlands . | |
| 1255974 | 12/1971 | United Kingdom | 4/506 |
| 2037580 | 7/1980 | United Kingdom . | |
| WO89/11316 | 11/1989 | WIPO . | |

*Primary Examiner*—Charles R. Eloshway
*Attorney, Agent, or Firm*—G. Brian Pingel; Brett J. Trout

[57] ABSTRACT

An in-ground pool with an inflatable flange and a non-rigid flexible body to permit the body to conform to the interior surface of a hole. The pool is designed with an exterior circumferential flange which is placed around the ledge of a hole dug in sand or soil which positions the body of the pool over the interior surface of the hole. The pool may then be filled with water with the interior surface of the hole acting as lateral support for the pool. The flange is secured to the ground with stakes which engage the flange and are driven into the ground around the exterior perimeter of the flange. When it is desired to remove the pool, the water is removed and the flange deflated so that the pool may be folded for storage and/or transport.

5 Claims, 6 Drawing Sheets

Fig. 5
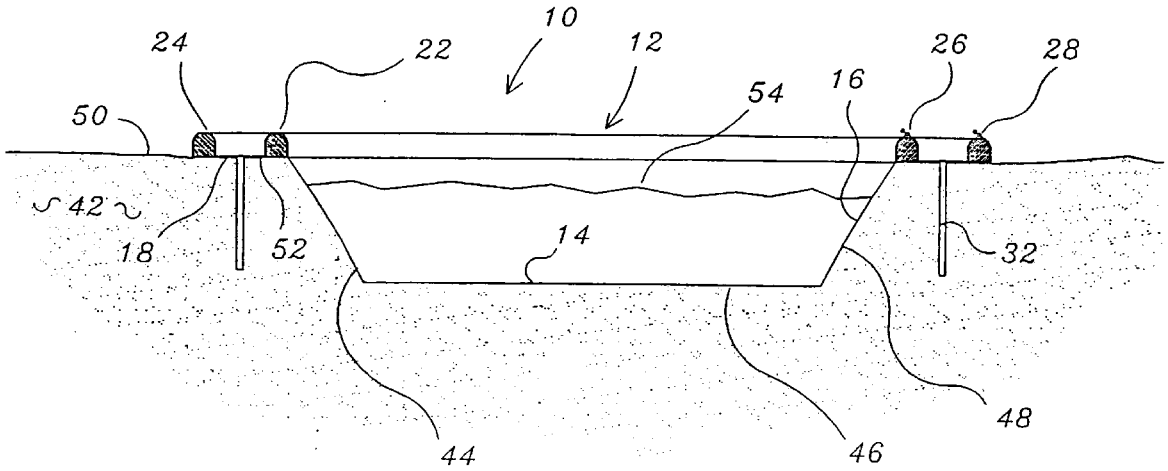
Fig. 8
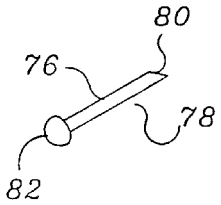
Fig. 6
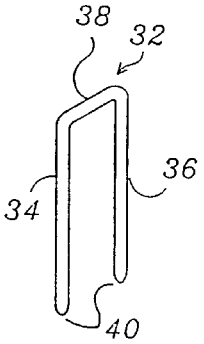
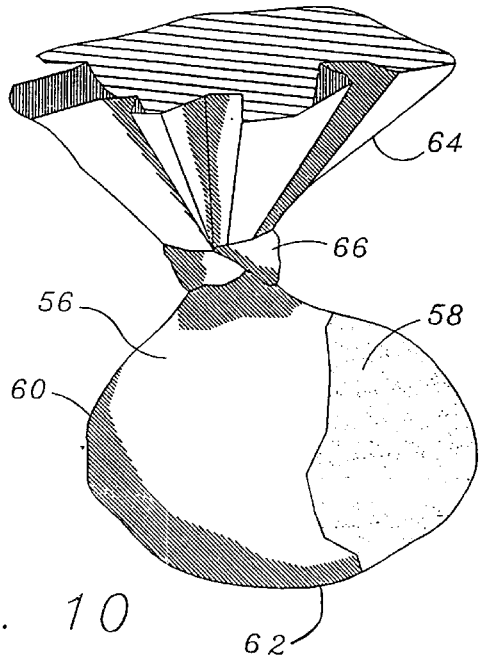
Fig. 10

PORTABLE IN-GROUND POOL

This application is a continuation-in-part of application Ser. No. 08/622,437, filed Mar. 25, 1996 now abandoned.

BACKGROUND OF THE INVENTION

1. Field of the Invention

The present invention relates in general to a portable pool, and, more specifically, to a portable pool having a flange and a flexible body capable of being placed over an in-ground hole and conforming to the interior surface thereof to provide the pool with lateral and base support.

2. Description of the Prior Art

Very large bodies of water pose a substantial risk of drowning to small children. Children can be overtaken by waves or pulled out to deep water by an undertow. Accordingly, it would be desirable to provide an area for small children to enjoy aquatic activities near large bodies of water without the danger of being overtaken by waves or pulled out to deep water.

Collapsible pools and pools having flexible sides are well-known in the art. Patents on such pools include U.S. Pat. No. 2,529,872, U.S. Pat. No. 4,597,113, U.K. Patent Application 3GB2,037,580, and U.S. Pat. No. 2,443,440.

The '872 patent discloses a collapsible pool provided with a buoyant marginal wall. To prevent water from escaping from the pool, the marginal wall is tapered radially downward and outward.

The '113 patent discloses an inner perimeter wall which tapers radially downward and outward.

The '580 patent discloses an inflatable pool with a flexible base and a flexible inflatable perimeter wall which does not taper radially downward and inward. Indeed, the perimeter wall would likely taper radially downward and outward when filled with water.

The '440 patent discloses an inflatable pool with flexible sides which taper radially downward and outward.

Although all of the above-described devices are adapted to provide a collapsible swimming pool, they all include flexible walls which provide marginal lateral stability and would quickly empty if a downward force were applied to the walls. Accordingly, it would be desirable to provide a collapsible pool within a hole provided in the ground so that the flexible walls would be provided with support by the interior surface of the hole. To increase the stability and integrity of the perimeter of the hole, the hole could be tapered downwardly and inwardly at least somewhat to prevent the ledge from collapsing down into the hole as weight is exerted thereupon.

In none of the aforementioned patents, however, is there taught or suggested means for constructing a collapsible pool with walls which taper inwardly and downwardly. Indeed, even if the walls of the aforementioned devices were modified to taper inwardly and downwardly, they would not be able to contain water above ground. Water would be positioned "over" the lower portion of the sidewalls tending to collapse the flexible sidewalls and making the pool prone to tipping. Accordingly, such a modification to the sidewalls of the aforementioned pools would defeat their direct intended use. The difficulties encountered in the prior art discussed hereinabove are substantially eliminated by the present invention.

SUMMARY OF THE INVENTION

The present invention provides an in-ground pool with a flange having an interior and an interior perimeter. The in-ground pool also has a sidewall secured to the interior perimeter of the flange and tapering toward the interior of the flange. In the preferred embodiment of the present invention, the perimeter flange is provided with means such as a tapered stake to allow the flange to be secured to a ledge of an in-ground hole. Additionally, the sidewall is a water-tight vinyl sheet which tapers downwardly and inwardly from the flange, thereby allowing the pool to substantially conform to an interior surface of the hole.

In use, the hole may be provided on a beach and the sidewall of the in-ground pool placed therein. The flange of the pool may be inflated and secured to the ledge of the hole with stakes or similar securement devices. The pool may then be filled with water which biases the sidewall toward the interior surface of the hole. Once the pool is filled, the interior surface of the hole provides lateral support for the pool, while the secured flange prevents the pool from shifting and stabilizes the hole against collapse.

BRIEF DESCRIPTION OF THE DRAWINGS

FIG. 5 is a side elevation in partial cross-section showing the pool of FIG. 1 installed in a hole and filled with water;

FIG. 6 is a perspective view of a two-prong stake used to secure the pool of FIG. 1;

FIG. 8 is a perspective view of a large-headed stake used to secure the pool of FIG. 7;

FIG. 10 is a side elevation in partial cross-section showing the sand-filled sack used with the present invention.

DETAILED DESCRIPTION OF THE PREFERRED EMBODIMENT

Figure 1:
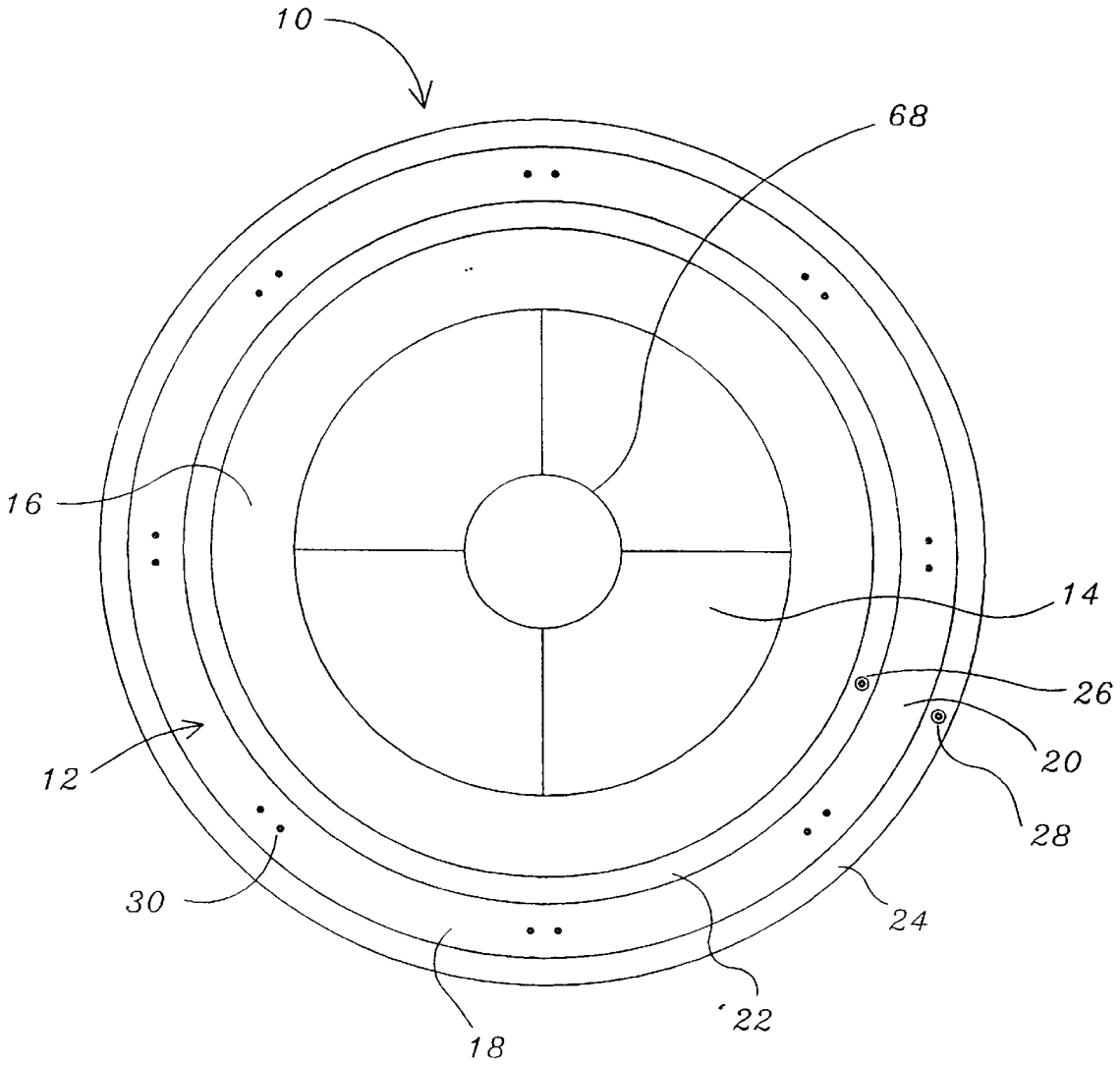
FIG. 1 is a top plan view of the in-ground pool of the present invention.
Figure 2:
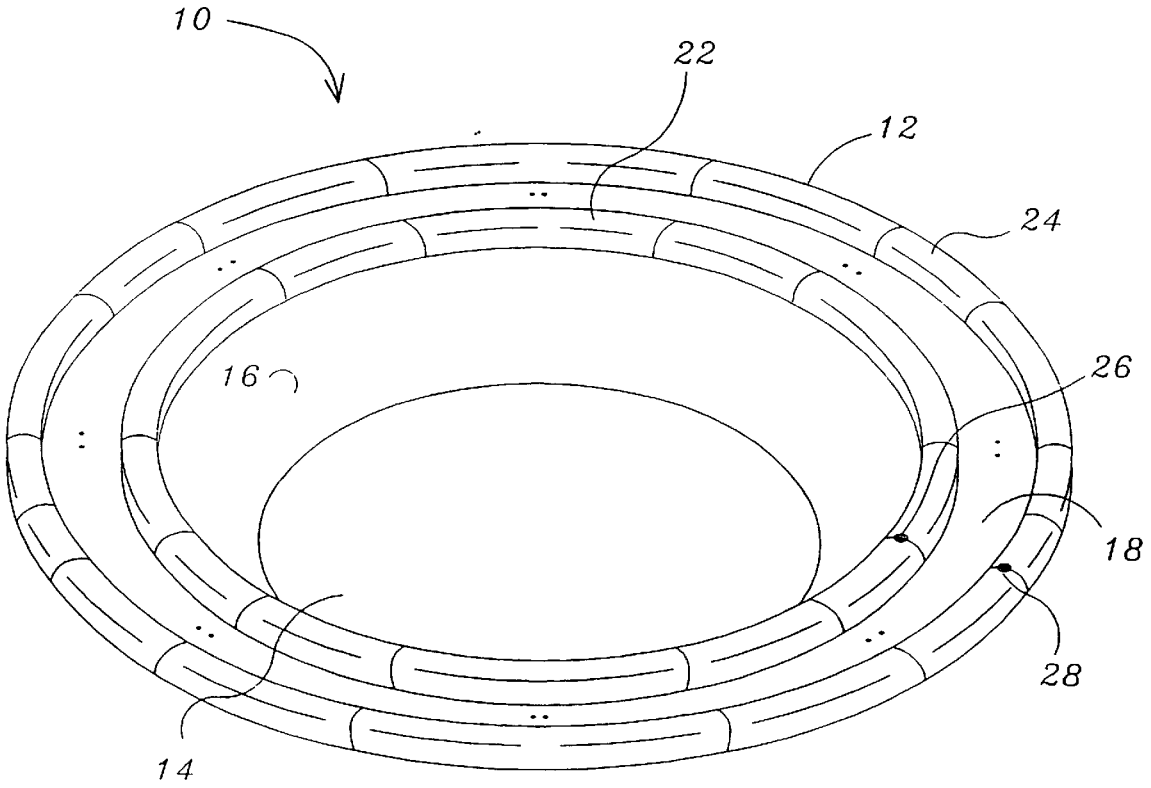
FIG. 2 is a perspective view of the pool of FIG. 1.

With reference to the drawings, a portable pool of the present invention is indicated generally as 10 in FIG. 1. As shown in FIG. 2, the pool 10 includes a vinyl pool liner 12 formed into a base 14, a sidewall 16, and a flange 18. Of course, it should be noted that the base 14, sidewall 16 and flange 18 may be constructed of separate pieces of vinyl secured together or of any flexible waterproof material. In the preferred embodiment, the pool 10 is circular and sixty-four inches in total diameter. The base 14 is forty inches in diameter with the sidewall 16 being eight inches long. In the preferred embodiment, the sidewall 16 slopes downward and inward from the flange 18 at a forty-five degree angle and meets the base at a forty-five degree angle as well. It should be noted, that while the preferred embodiment of the present invention is provided with the aforementioned geometry, any dimensions or geometry with inward and downward sloping sidewalls may be provided to accommodate specific requirements for a particular pool.

To aid in the setup and portability of the present invention, the pool preferably has a capacity of no more than two kiloliters of water and when filled, is no more than three meters across the surface of the water when filled. Preferably, it is even more desirable to provide the pool with a capacity of no more than one kiloliter of liquid and a dimension no more than two meters across when filled.

Figure 3:
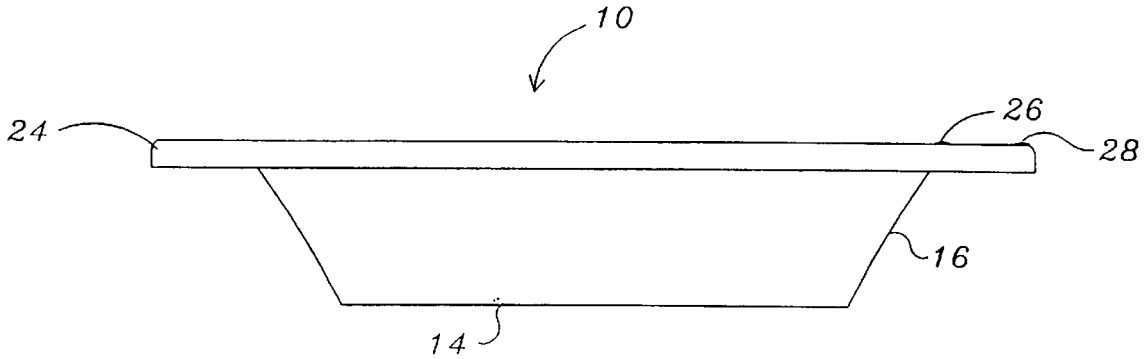
FIG. 3 is a side elevation of the pool of FIG. 1.
Figure 4:
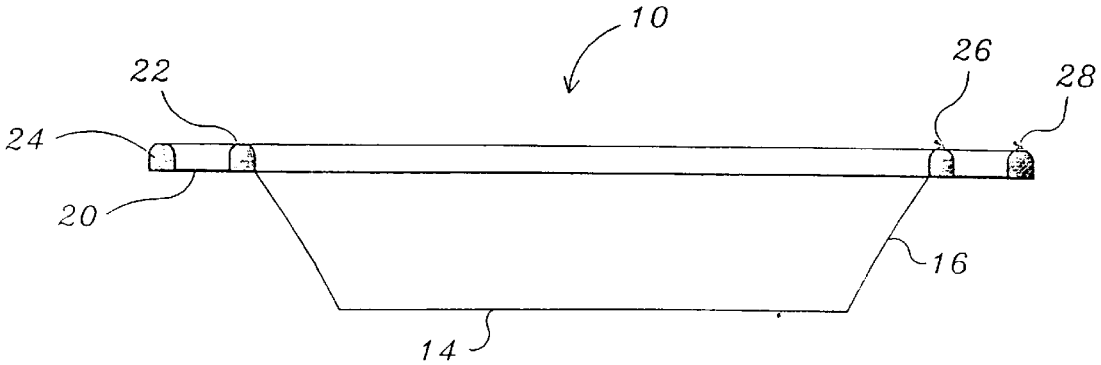
FIG. 4 is a side elevation in partial cross-section showing the pool of FIG. 1.

As shown in FIGS. 2 and 4, an annular portion of vinyl 20, similar in dimensions to the flange 18 is secured to the flange 18 by vinyl welding, adhesive or similar securement means. No welding is done along two concentric rings on the flange 18. The annular portion of vinyl 20 is thereby secured to the flange 18 in such a manner so as to provide a first annular inflatable ring 22 and a second annular inflatable ring 24. Each inflatable ring 22 and 24 is three inches in diameter. Additionally, the first inflatable ring 22 is provided with a first inflation valve 26, while the second inflatable ring 24 is provided with a second inflation valve 28 (FIGS. 3 and 4). As shown in FIG. 1, provided between the first inflatable ring 22 and second inflatable ring 24 are eight pairs of grommets 30. The pairs of grommets 30 are preferably three-quarter inch aluminum eyelets vinyl welded or otherwise secured to the flange 18 and annular portion of vinyl 20. The centers of the grommets 30 are reamed out to provide a passageway through the annular portion of vinyl 20 and flange 18.

To secure the pool 10, eight stakes 32 are provided (FIG. 6). Each stake 32 is provided with a first prong 34 and second prong 36 spaced apart by a connector 38. The length of the connector 38 is equal to the distance between the grommets in each pair of grommets 30. As shown in FIG. 6, the first prong 34 and second prong 36 are provided with rounded ends 40 to minimize the danger of children poking each other with the stakes 32. In the preferred embodiment, the stakes 32 are molded of plastic into a cylindrical shape approximately one-half inch in diameter. It should be noted that the stakes 32 may be constructed of metal, wood, or any other suitable material and may be constructed of any suitable dimensions to stabilize and secure the pool 10 (FIGS. 1 and 6).

As shown in FIG. 5, to use the pool 10 of the present invention, a portion of beach 42 or similar ground is chosen to place the pool 10. A hole 44 is then dug into the beach 42. The hole 44 is preferably constructed with a circular bottom 46 having a diameter similar to the diameter of the base 14 of the pool 10. Sides 48 of the hole 44 are then tapered upward toward the surface 50 at a forty-five degree angle. It should be noted that depending on the angle of repose of the particular material in which the hole 44 is dug, the slope of the sides 48 of the hole 44 may be adjusted to prevent the ledge 52 of the hole 44 from collapsing into the hole 44. Due to the resiliency of the vinyl pool liner 12, the pool 10 can, within a range of predetermined parameters, comport to varying side slopes, base diameters and depths of a particular hole 44.

To use the pool 10 the first inflatable ring 22 and second inflatable ring 24 are either manually or mechanically inflated through the first inflation valve 26 and second inflation valve 28 respectively (FIG. 4). Once the first inflatable ring 22 and second inflatable ring 24 are properly inflated, the pool 10 is placed over the hole 44 with the flange 18 being placed around the ledge 52 created by the hole 44 in the beach 42 (FIG. 5). Once the pool 10 is in place over the hole 44, the stakes 32 are then manually inserted through the pairs of grommets 30 to secure the flange 18 to the ledge 52 (FIGS. 1 and 5). Once the pool 10 has been secured by the stakes 32, water 54 may then be added to the pool 10 as shown in FIG. 5.

To remove the pool 10, the stakes 32 are removed from the pairs of grommets 30 and the pool 10 is lifted to remove the water 54 from the vinyl pool liner 12 (FIGS. 1 and 5). The first inflation valve 26 and second inflation valve 28 are then opened to allow the escape of air from the first inflatable ring 22 and second inflatable ring 24 (FIG. 4). Once the air has been removed, the pool 10 may then be folded for transport and/or storage.

Figure 7:
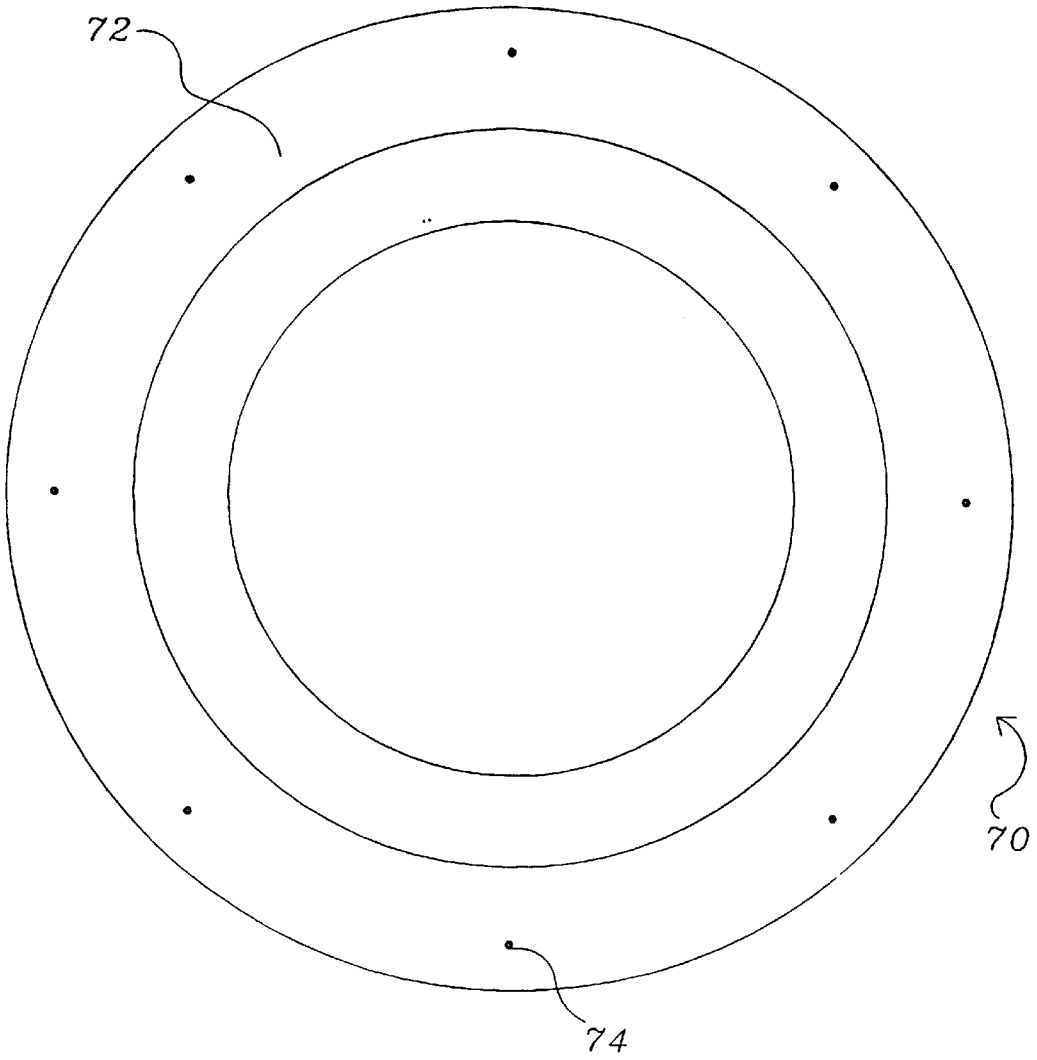
FIG. 7 is a top plan view of an alternative embodiment of the present invention shown with single hole securement grommets and no inflatable rings.

Shown in FIG. 10 is a sack 56 filled with sand 58. While in the preferred embodiment the sack 56 is constructed of cloth, the sack 56 may, of course, be constructed of any material capable of holding sand 58. In the unfilled state, the sack 56 has a cylindrical body 60 eight inches long secured to a circular base 62 four inches in diameter. The sack 56 may be filled with sand 58 and the top 64 of the sack 56 provided with a knot 66 to maintain the sand 58 within the sack 56. Preferably, several colored sacks 56 are provided to allow their use in a tossing game in which players stand a predetermined distance from the water-filled pool 10 and take turns attempting to toss the sand-filled sack 56 into the water 54 within the pool 10 (FIGS. 1, 5, and 7). The distance may be adjusted to comport with the ages and skills of the players. As shown in FIG. 1, the pool 10 is preferably provided with target markings 68 along the base 14 of the pool 10 to reflect various point scores for tossing the sack 56 onto various areas of the pool 10.

Shown in FIG. 7 is a first alternative pool 70 which is provided with a flange 72 of increased thickness but which is not provided with any inflatable rings. Additionally, the first alternative pool 70 is provided with single grommets 74 instead of pairs of grommets to accommodate a stake 76 such as that shown in FIG. 8. As shown in FIG. 8, the stake is provided with a single shaft 78, a tapered, more pointed tip 80 and a large flat head 82 to securely fasten the double thick flange 72 of the first alternative pool 70 (FIGS. 7 and 8).

Figure 9:
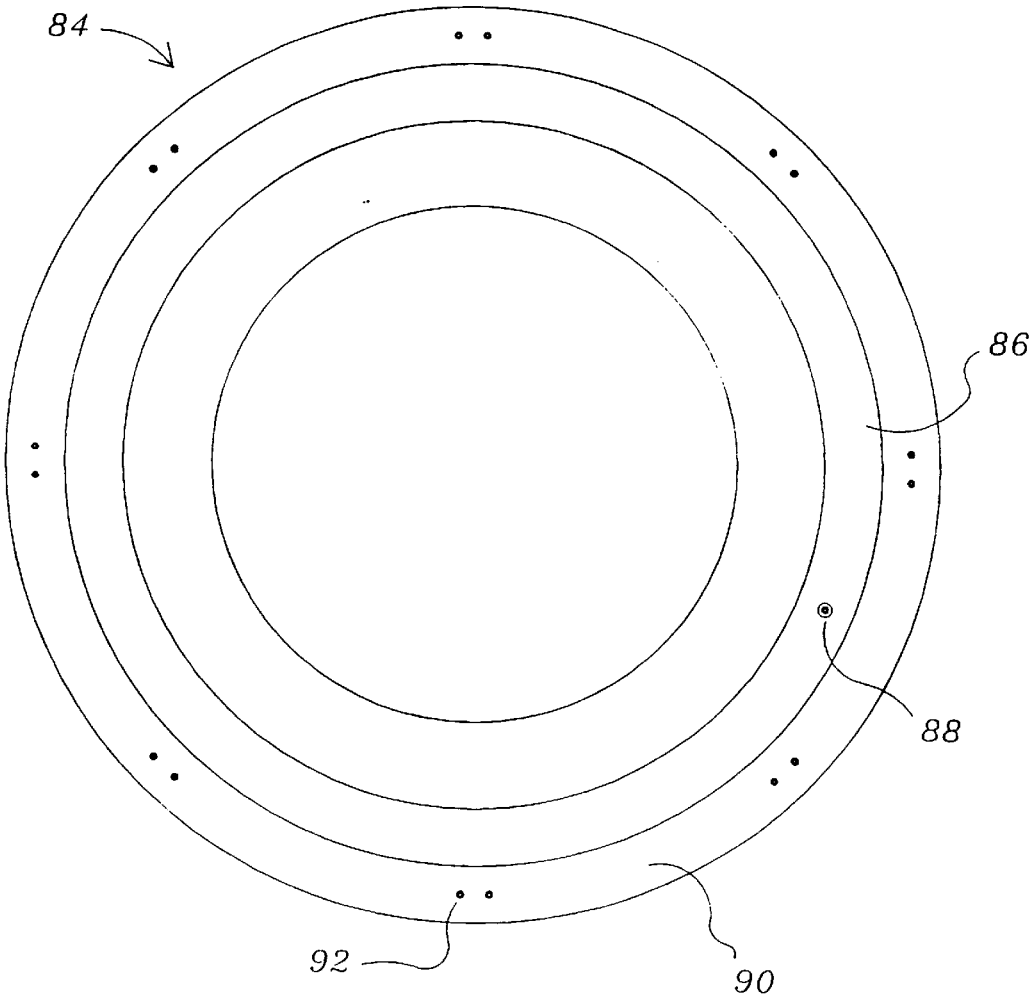
FIG. 9 is a top plan view of an alternative embodiment of the present invention shown with a single inflatable ring and securement grommets provided around the exterior perimeter of the pool.

Shown in FIG. 9 is a second alternative pool 84 provided with only a single inflatable ring 86 and a single inflation valve 88. The flange 90 of the second alternative pool extends outward beyond the single inflatable ring 86 and is provided with eight pairs of grommets 92 similar to those provided in the portable pool 10 of the preferred embodiment.

Although the invention has been described with respect to a preferred embodiment thereof, it is to be understood that it is not to be so limited, since changes and modifications can be made therein which are within the full intended scope of this invention as defined by the appended claims. For example, it is anticipated that the pool of the present invention may be constructed of any geometric shape having suitable dimensions for the placement in a hole and retention of water. For example, it is anticipated that the pool may be provided in the shape of a triangle with a flange which is retained at the points of the triangle.

What is claimed is:

1. A method for constructing an in-ground pool comprising:

(a) providing an in-ground pool, comprising:

(i) a top flange having an interior perimeter, said interior perimeter being about sixty-four inches across; and (ii) a flexible water-tight body secured to said interior perimeter of said flange, said water-tight body, when filled with a liquid, being of a construction which tapers inwardly and downwardly away from said flange, wherein substantially all of said water-tight body is positioned downward and inward of said interior perimeter of said flange; and (b) digging into the ground to provide a hole which tapers inwardly and downwardly;

(c) placing said in-ground pool into said hole; and (d) inflating said flange from a nonrigid state to a rigid state;

(e) filling said in-ground pool with a liquid.

2. The method of constructing an in-ground pool of claim 1, further comprising securing said flange to the ground.

3. The method of constructing an in-ground pool of claim 1, further comprising securing said flange to the ground with stakes placed through holes provided in said flange.

4. The method of constructing an in-ground pool of claim 1, further comprising providing a plurality of markings on said sidewall and further comprising throwing a projectile into the in-ground pool and covering at least a portion of at least one of said plurality of markings.

5. The method of constructing an in-ground pool of claim 4, further comprising placing sand within a sack to form said projectile.

* * * * *